United States Patent [19]

Patterson

[11] Patent Number: 4,810,031

[45] Date of Patent: Mar. 7, 1989

[54] COMBINATION PORTABLE SEAT AND TRASH CONTAINER

[76] Inventor: Jack O. Patterson, 369 Riverbluff Pl., #2, Memphis, Tenn. 38103

[21] Appl. No.: 240,260

[22] Filed: Sep. 6, 1988

[51] Int. Cl.[4] ..... A47C 7/62

[52] U.S. Cl. ..... 297/192; 248/97; 248/99; 297/188; 297/193

[58] Field of Search ..... 297/192, 193, 188; 248/95, 97, 99

[56] References Cited

U.S. PATENT DOCUMENTS 3,415,572 12/1968 Zaginin ..... 297/192
3,773,286 11/1973 Govoni et al. ..... 248/99
4,379,587 4/1983 Duncan ..... 297/192
4,705,246 11/1987 Wolf ..... 248/97

*Primary Examiner*—James T. McCall
*Attorney, Agent, or Firm*—John J. Mulrooney

[57] ABSTRACT

A combination portable seat and trash container consisting of a hollow rectangular cube made of rigid plastic having a bottom rectangular rim, four legs extending upwardly from the bottom rim, and a rectangular-shaped top rim resting on the legs, the top rim having three straight members and a fourth member having a V-shape, a trash container located in the space defined by the rectangular cube structure, and a seat cushion mounted on the top rim. The space defined by the seat cushion and the V-shaped member of the top rim defining an opening and providing for access to the trash container within the cube structure.

4 Claims, 1 Drawing Sheet

COMBINATION PORTABLE SEAT AND TRASH CONTAINER

BACKGROUND OF THE INVENTION

This invention relates to a new and improved COMBINATION PORTABLE SEAT AND TRASH CONTAINER.

In the past, there have been seating devices which have combined the features of collapsibility and space for the stowage of gear. Such prior devices have been complicated, or heavy, or expensive to manufacture, or awkward in appearance, and have usually been quite limited in relation to size and the amount of stowage space. See, for example, U.S. Pat. Nos. 2,163,759: 2,375,819; 3,128,137: and 3,290,089. An attempt has been made in U.S. Pat. No. 3,724,745 to provide a combination bar stool and refuse container; however, that device is not portable or collapsible, and is not designed or intended for use in such outdoor places as patios and boats.

It is, therefore, an object of this invention to provide a very simple, inexpensive to manufacture, portable combined seat and trash container having a comparatively large stowage space.

Another object of this invention is to provide a combination seat and trash container that is of lightweight construction as to be readily movable, and that can be collapsed or broken down to be stored or transported in a minimum amount of space.

Another object of the present invention is to provide a combination seat and trash container having a design that permits the person using the seat to have access to the trash receptacle without moving from the seat.

Another object of the present invention is to provide a combination seat and trash container useful with market available trash bags.

Another object of the present invention is to provide a combination seat and trash container comprising structural components manufactured as standard items in various sizes, thereby enabling the invention to be economically designed and manufactured in many different sizes.

Another object of this invention is to provide a combination seat and trash container that is lightweight yet stable as to be useful on boats and other outdoor places.

SUMMARY OF THE INVENTION

In accordance with the present invention, a combination seat and trash container is constructed of pieces of durable PVC plastic tubing and PVC joints assembled in the shape of a hollow rectangular cube. One member of the top of the cube is shaped in the form of a V. The size of the cube structure is such that the mouth of a market available plastic bag will fit over the cube frame. A seat is positioned on the side of the cube having the V-shaped member, whereby the space defined by the seat and the V-shaped member provides an opening for access to the trash container in the cube structure.

BRIEF DESCRIPTION OF THE DRAWINGS

These and additional objects, features and advantages of the present invention will become apparent by reference to the following detailed description of the preferred embodiment thereof in connection with the accompanying drawing wherein.

DESCRIPTION OF THE PREFERRED EMBODIMENT

Figure 1:
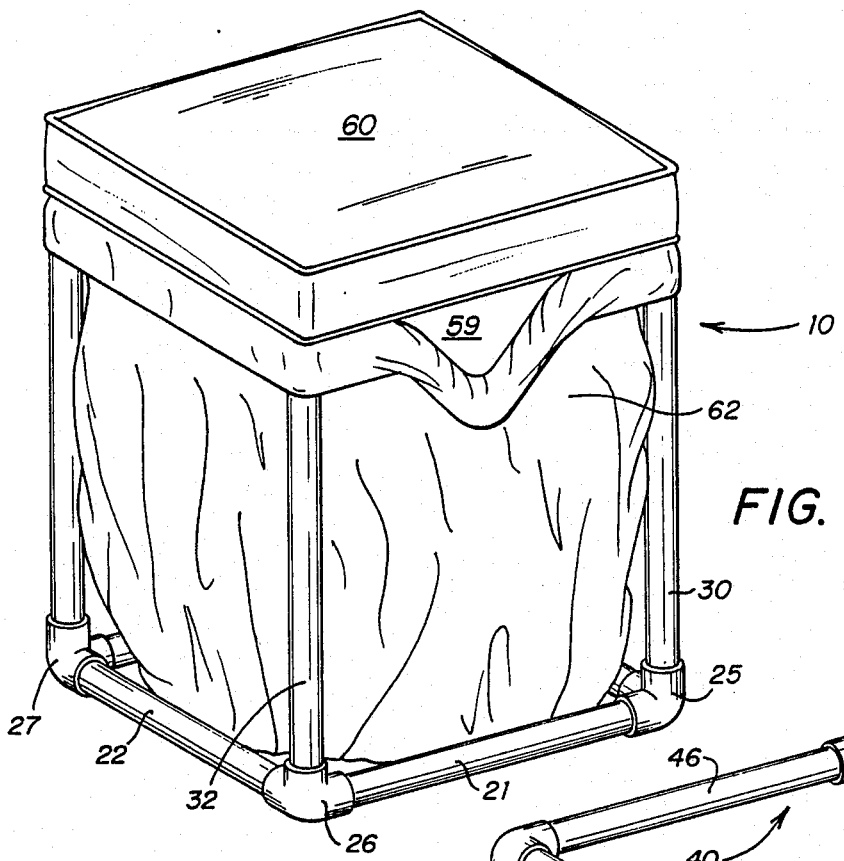
FIG. 1 is a perspective view of the invention including the seat cushion and trash container.
Figure 2:
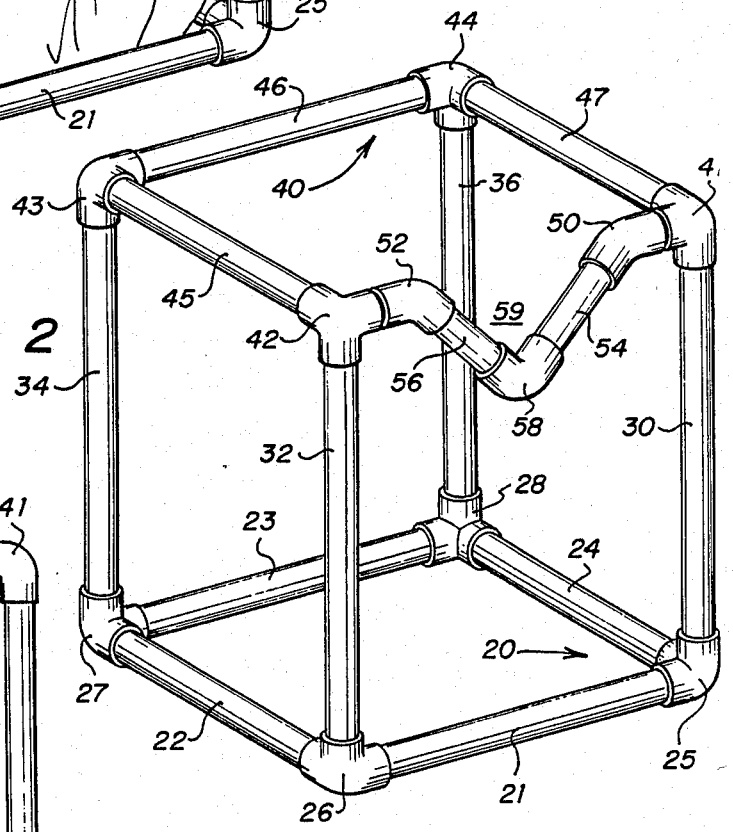
FIG. 2 is a perspective view of the invention without the seat cushion and the trash container.
Figure 3:
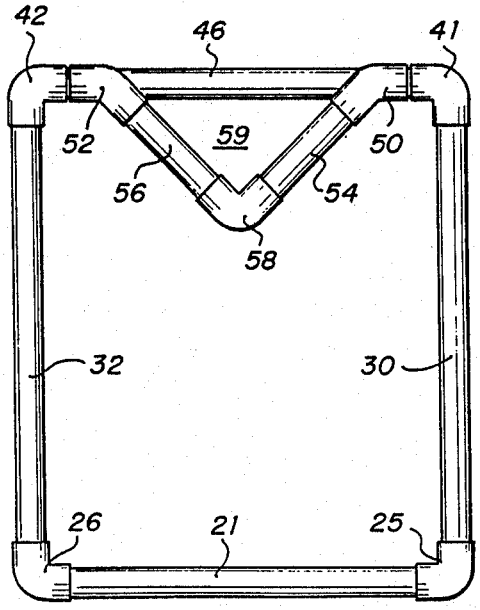
FIG. 3 is a view in side elevation of the invention, without the seat cushion and the trash container, and showing the "V" shaped trash opening.

Referring now to the figures in greater detail, where like reference numbers denote like parts, the combination portable seat and trash container is generally designated by the reference number 10. The seat structure or frame comprises a bottom rim or base generally designated by reference number 20 comprising straight or tube members 21, 22, 23, and 24: and 90-degree side exit joint corners 25, 26, 27 and 28. The bottom rim members are designed to form a plane surface to engage the ground or floor surface where the invention is used.

Legs comprising straight or tube members 30, 32, 34 and 36 engage and extend upwardly from corner joints 25, 26, 27 and 28, respectively.

A top rim generally indicated by the reference number 40 comprises 90-degree side exit joint corners 41, 42, 43, and 44: and straight or tube members 45, 46 and 47. The top rim members 41 through 47 are designed to form a plane surface adapted to receive and support a seat cushion 60.

One member of the top rim 40 comprises 45-degree joints 50 and 52, straight or tube members 54 and 56 and a 90-degree joint 58, all connected between joint corners 41 and 42, to form an V-shaped opening 59 immediately below the plane of top rim 40.

The seat cushion 60 may be a vinyl covered foam pad and plywood assembly having corner blocks (not shown) on the bottom thereof which are useful to locate and maintain the seat cushion on the top rim 40.

The size of the top rim 40 is designed so that the opening of a market available plastic bag 62 will fit over, and be supported by, the top rim 40 and the plastic bag will occupy the space defined by the bottom rim 20, the legs 30, 32, 34 and 36, the top rim 40 and the seat cushion 60.

All of the straight members and joints of this invention are made of polyvinyl chloride (PVC), or other suitable, durable, hollow and lightweight material having sufficient strength and rigidity. All of the PVC parts of the seat structure are items which are manufactured as standard items in various sizes, thereby enabling the structure to be economically designed and manufactured in different sizes for use with different sizes of market available plastic bags. For example, for a seat assembly comprising legs which are 15" long and 1" inner diameter, and a top rim having 13" straight members and a bottom rim having 13" straight members, a 30 gallon bag will fit snugly over the opening defined by top rim 40.

The combination seat and trash container may be designed to be totally collapsible and portable by allowing for the disassembly of all members. However, the inventor has found that by gluing the top rim members together, and the bottom rim members together, and permitting the four legs to be separable from the top and bottom rims, the invention is stable during use, yet readily collapsible into eight distinct parts (top rim, bottom rim, four legs, cushion and trash bag) to allow the invention to be highly portable and/or to be stored in a minimum of space.

A person desiring to use the combination seat and trash container on a boat, or a patio, or other location, will place the bottom rim on a flat surface, insert the four upstanding legs into the bottom rim, and place the top rim on the legs. The opening of a plastic bag will then be placed around the top rim 40 and the plastic bag 62 will be pulled into the space defined by the seat structure. After the seat cushion is placed on the top rim, a person can sit on the seat and place trash into the plastic bag through V-shaped receptacle opening 59 without leaving the seat.

Thus, it will be readily seen that the present invention provides a combination seat and trash container which is portable, collapsible, durable, lightweight and stable, which may be economically constructed from parts that are manufactured as standard items, and which permits a person seated thereon to dispose of trash in the container without moving from the seat.

From the foregoing, it will now be seen that there is herein provided and disclosed a combination seat and trash container which accomplishes all of the objects of this invention, and others, including many advantages of great practical utility and commercial importance.

While various changes may be made in the detailed construction, it is understood that such changes will be within the spirit and scope of the present invention.

What is claimed is:

1. A combination seat and trash container comprising:

a bottom rim designed to form a plane surface for engaging the ground or other flat surface;

legs adapted to engage and be supported by said bottom rim and extending upwardly therefrom;

a top rim supported by said legs and designed to form a plane surface, said top rim having a V-shaped member, whereby a receptacle opening is formed between said plane surface and said V-shaped member;

a receptacle supported by said top rim: and a seat cushion adapted to cover and be supported by said top rim.

2. The combination seat and trash container of claim 1, wherein said bottom rim and said top rim comprise integral units which are separable from said legs.

3. The combination seat and trash container of claim 1, wherein said receptacle comprises a plastic bag.

4. The combination seat and trash container of claim 1, wherein said bottom rim, said legs and said top rim comprise PVC straight tube members and joints.

* * * * *